United States Patent [19]

Hobson

[11] Patent Number: 4,497,606

[45] Date of Patent: Feb. 5, 1985

[54] FORK LIFT TRUCK ATTACHMENT

[76] Inventor: Lloyd L. Hobson, 312 North East St., Elnora, Ind. 47529

[21] Appl. No.: 399,334

[22] Filed: Jul. 19, 1982

[51] Int. Cl.[3] ..... B66F 9/06

[52] U.S. Cl. ..... 414/607; 414/785

[58] Field of Search ..... 414/497, 607, 661, 785; 187/9 R

[56] References Cited

U.S. PATENT DOCUMENTS

| | | | |
|---|---|---|---|
| 2,302,137 | 11/1942 | Neuman | 414/785 |
| 2,818,989 | 1/1958 | Burke | 414/785 X |
| 2,847,138 | 8/1958 | Backofen et al. | 414/785 |
| 3,023,919 | 3/1962 | Hobson | 414/607 |
| 3,200,978 | 8/1965 | Brady et al. | 414/607 X |
| 3,477,600 | 11/1969 | Sawyer | 414/607 X |
| 3,734,329 | 5/1973 | Grelck | 414/785 |
| 3,825,139 | 7/1974 | Geis | 414/667 X |
| 4,024,972 | 5/1977 | Hobson | 414/607 |

FOREIGN PATENT DOCUMENTS

| | | | |
|---|---|---|---|
| 1567769 | 5/1969 | France | 187/9 R |

*Primary Examiner*—Leslie J. Paperner
*Assistant Examiner*—Ken Muncy
*Attorney, Agent, or Firm*—Barnes & Thornburg

[57] ABSTRACT

An attachment for a lift truck having a vertically movable carriage includes a frame and a carrier slidably engaged within the frame attachable to the carriage of a lift truck. The carrier has at least one receiving pocket and a gate for substantially closing the receiving pocket. A load-supporting element is removably supported on the carrier. The load-supporting element includes a bracket received in the receiving pocket of the carrier and retained by the gate for maintaining the load-supporting element in operable position on the carrier.

12 Claims, 5 Drawing Figures

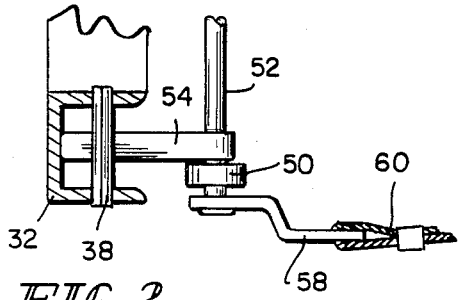
FIG. 2
FIG. 3
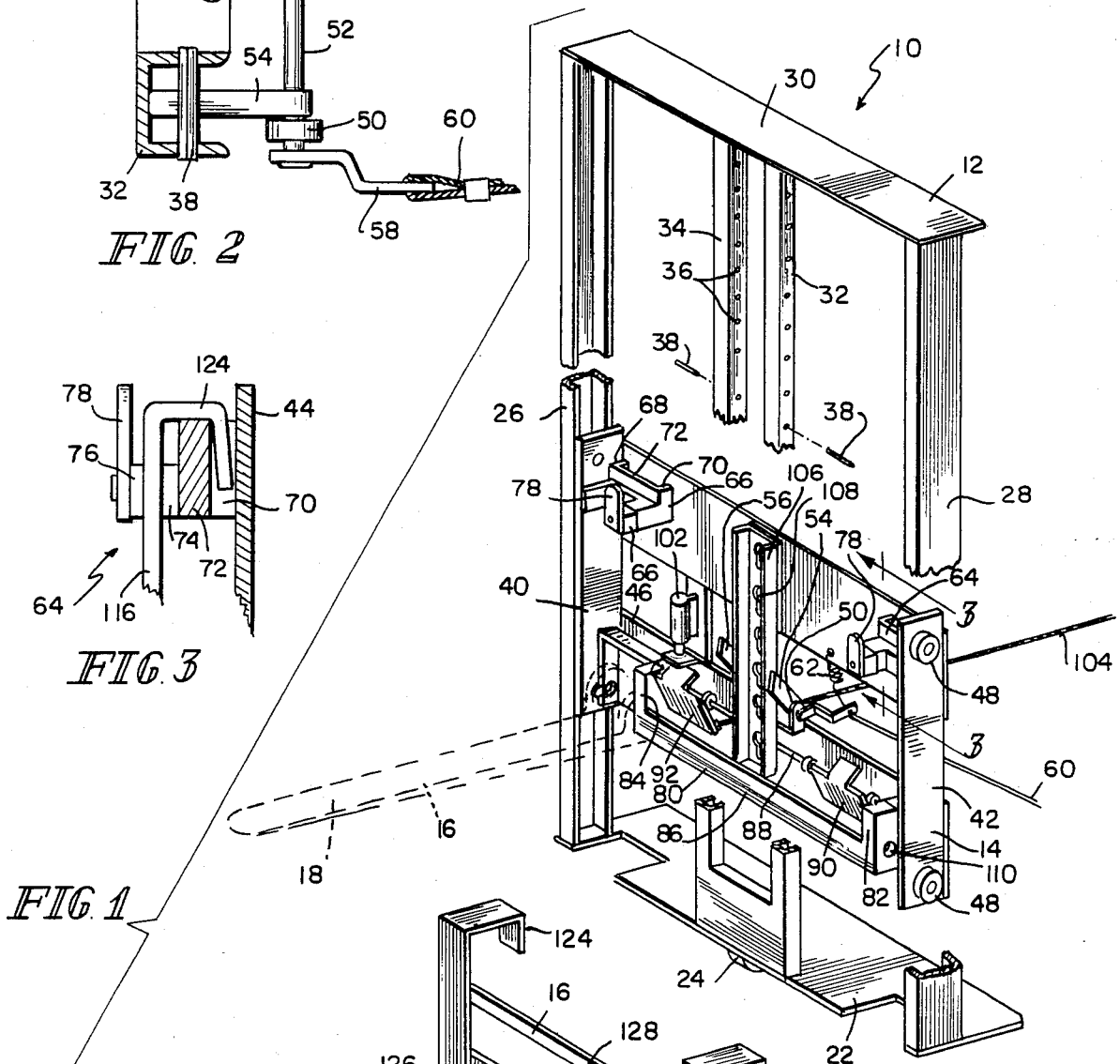
FIG. 1
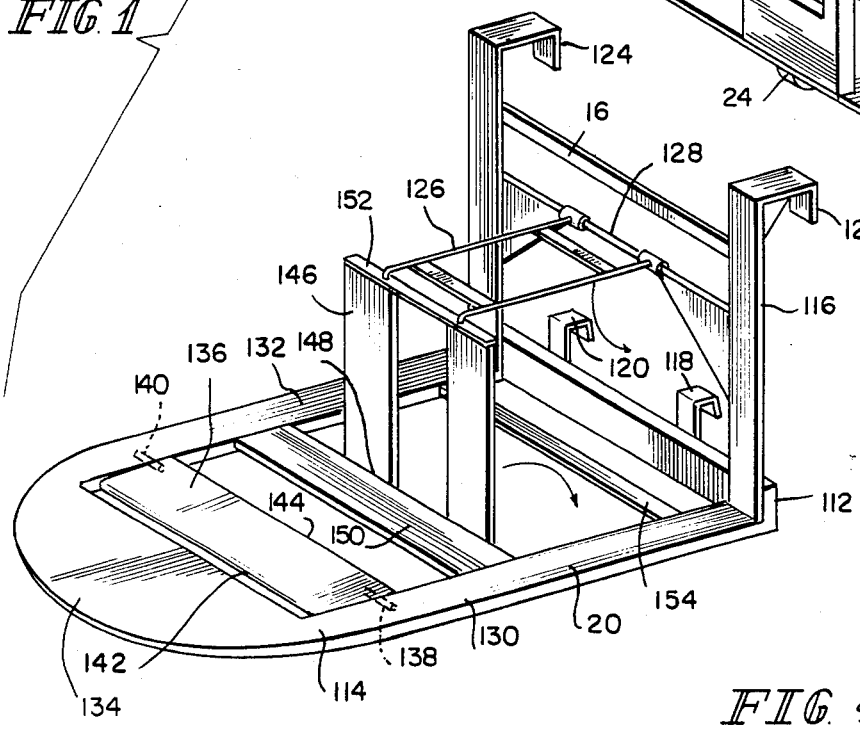
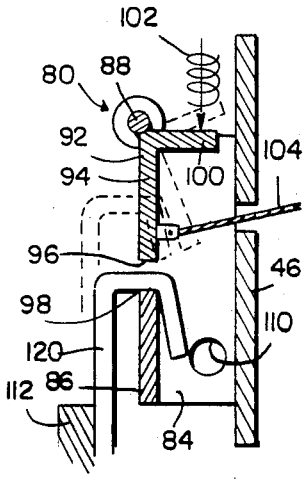
FIG. 4

FORK LIFT TRUCK ATTACHMENT

The present invention is directed generally to off-road wheeled article handling devices generally referred to as industrial forklift trucks. The invention is more particularly directed to attachments to be applied to the carriage of a forklift truck, which attachment is intended for the advantageous placement and retrieval of tiered containers, particularly in restricted overhead space situations.

A great variety of special article handlers have been developed which are intended for use with conventional forklift trucks. A substantial number of the devices require electrical or hydraulic hook-up to the available systems on the forklift trucks, which hook-up in turn requires the specific presence of either the electrical system or the hydraulic system in the forklift truck. Conventional forklift trucks usually include an electrical or hydraulic drive system, but usually not both. Hence, attachment mechanisms which require the specific application of either electrical or hydraulic hook-up tend to exclude a significant portion of available lift trucks due to their non-compatibility. The present invention is designed to derive its functional working power merely from the vertical movement of the conventional carriage which is present on all standard lift trucks.

Specific attachments have been designed for the placement and retrieval of containers of goods at various elevated heights, but few are specifically intended to place and/or retrieve tiered containers where the container sought to be placed or retrieved is recessed a significant distance from the working face of the container stack. The present invention is specifically intended to advantageously place or retrieve containers at significant distances behind the working face of a tier of similar containers. The invention is further intended to effect the advantageous placement and/or retrieval in situations where restricted overhead space requires limited vertical mast movement.

Generally, the invention may be viewed as an attachment which includes a frame, a carrier slidably engaged within the frame, and a load-supporting element removably supported on the carrier. The carrier is attachable to the carriage of a conventional lift truck. The carrier includes at least one receiving pocket and a locking gate for substantially closing the receiving pocket. The load-supporting element is removably attached to the carrier by brackets which are received in the receiving pockets of the carrier. The bracket or brackets are retained in the pockets by the locking gate to thereby maintain the load-supporting element in operable position on the carrier.

The carrier is releasably linked to the frame in such a manner as to provide back support for tall loads, yet can be made to independently move where low overhead obstructions are encountered. The carrier can support folding forks or a horizontally disposed blade or flat scoop, and in this manner can adapt to different types of loads and containers. The flat scoop load support is connected to the carrier by locking gates which securely attach the flat scoop to the carrier. The locking gates can be easily released by the operator without leaving the operational position of the lift truck. Additionally, the whole attachment mechanism is passive, that is, it requires no electrical or hydraulic hook-up, but merely derives its power from the vertical movement of the standard carriage on the lift truck to which it is attached.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which:

FIG. 1 is a perspective view of the various elements of the invention;

FIG. 2 is a sectional detail showing the portion of the invention intended to releasably fix the vertical relationship between the frame and carrier;

FIG. 3 is a sectional detail taken along line 3—3 of FIG. 1 showing a part of the attachment mechanism between the carrier and load support; and FIG. 4 is a sectional detail showing additional features of the attachment mechanism between the carrier and load support.

Figure 5:
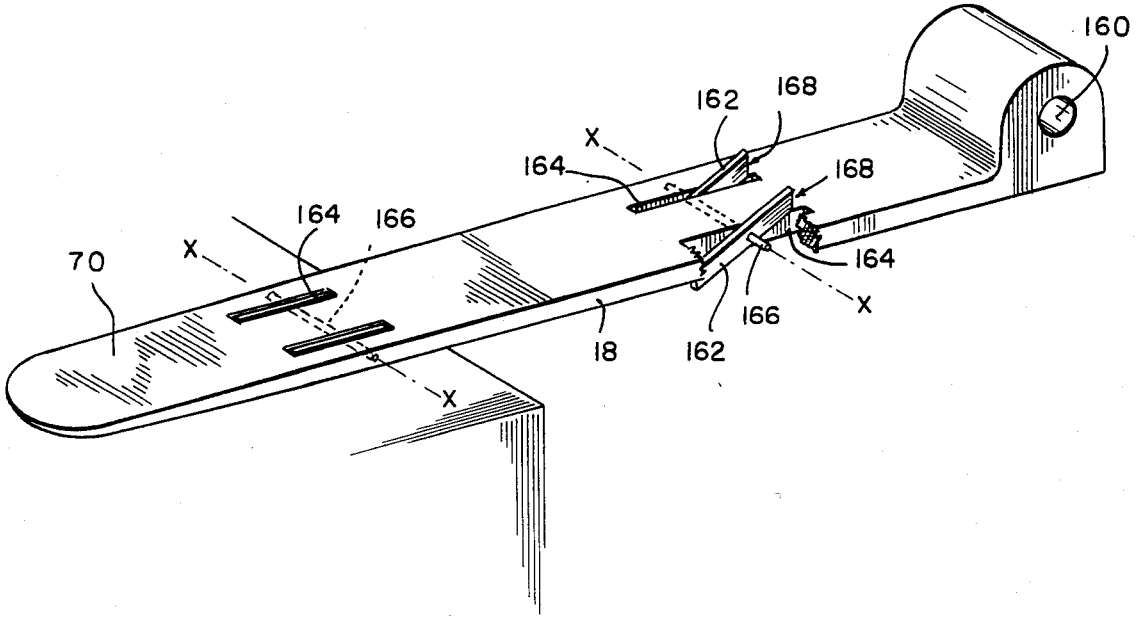
FIG. 5 is a perspective view of a foldable fork attachable to the carrier.

As shown in the accompanying figures, the attachment 10 includes a frame 12, a carrier 14, and a load-support means 16 which is removably attachable to the carrier. The load-support means 16 can be forks 18 pivotally supported to the carrier 14 or a horizontal blade or spoon 20 which can be lockably attached to the carrier 14. The frame 12 consists of a bottom plate 22 which can be supported on centrally situated ground-engaging wheels 24. A pair of inwardly facing opposed side channels 26 and 28 extend upward from bottom plate 22 to a top plate 30, thereby forming a generally rectangular array. A pair of rearwardly facing guide channels 32 and 34 are fixed between the bottom plate 22 and top plate 30, and each guide channel 32, 34 includes a plurality of apertures 36 vertically separated from each other into which stops 38 can be incorporated. More than one stop 38 can be situated in each of the guide channels 32 and 34 in accordance with a particular intended use of the present invention.

The carrier 14 is comprised of side members 40 and 42 fixed with respect to each other by back plates 44 and 46. Each of the side members 40 and 42 carry a pair of bearings or rollers 48 which are engaged into side channels 26 and 28 to define the vertical path of the carrier 14 with respect to the frame 12. The back plates are securable to the vertically movable carriage of a conventional lift truck by clamps such that the carrier 14 of attachment 10 and the carriage of the lift truck move vertically as a unit.

A bracket 50 is fixed to a front upper portion of lower back plate 46. The bracket 50 shown in elevation detail in FIG. 2 defines the axis of rotation of a pivot rod 52 to which is fixed a pair of dogs 54 and 56, which dogs are received in the guide channels 32 and 34, respectively. An actuator 58 is also fixed to pivot rod 52, the actuator 58 being in turn connected to control line 60 for remote actuation of the actuator 58 by the driver of the fork lift to which apparatus 10 is attached. The pivot rod 52 is biased by a biasing means such as spring 62 such that dogs 54 and 56 will engage stops 38 in guide channels 32 and 34.

The carrier 14 also includes a pair of pockets 64 and 66 fixed to the forward side of upper back plate 44. Each pocket 64 and 66 comprises a pair of vertically oriented flanges 68 and 70 fixed to the back plate 44, the flanges 68 and 70 being joined by a web 72 which is situated in spaced parallel relationship to the back plate 44. A solid filler block 74 is fixed to the front surface of web 72 and to one side of filler block 74 is fixed post 76. A retainer 78 is pivotally connected to post 76, the retainer being of sufficient length such that when pivoted to a horizontal position it occupies a major portion of the space between post 76 and the side member 40 or 42 to which it is most nearly adjacent. With retainer 78 pivoted to the horizontal position, there is a space between retainer 78 and filler block 74 for receiving selected elements of an appropriate load support discussed below. A sectional detail of the top pocket 64 which is merely the mirror image of top pocket 66 is shown in section in FIG. 3.

A bottom pocket 80 is fixed to the front surface of the lower back plate 46. The bottom pocket 80 is formed by a pair of vertical support blocks 82 and 84 fixed to back plate 46, with a front plate 86 being fixed at the front surface of the lower portion of the vertical support blocks 82 and 84. At the top of support blocks 82 and 84 is a pivot rod 88 to which is fixed a pair of inverted L-shaped gates 90 and 92. The lower portion 94 of gate 92, when positioned vertically below pivot rod 88, is aligned in the same plane as plate 86. The lower edge 96 of the lower portion 94 is spaced from the upper edge 98 of plate 86 as shown in FIG. 4. The upper portion 100 of the inverted L-shaped gate 92 is acted upon by a biasing means 102 shown schematically in FIG. 4 which biases gates 90 and 92 toward a closed position as shown in solid lines in FIG. 4. A control line 104 is attached to the gate 92 so that the gates 90 and 92 may be rotated with pivot rod 88 to the position shown in phantom in FIG. 4 and as shown in FIG. 1 to permit the insertion of an appropriate load-supporting bracket.

The carrier 14 further includes at least one attachment bar 106 vertically situated between the two guide channels 32 and 34 of frame 12. The attachment bar 106 includes a plurality of apertures 108 into which a top lift attachment bar or other load-supporting mechanism can be inserted. The vertical support blocks 82 and 84 additionally contain side facing apertures 110 intended to receive a pivot pin by which load-supporting forks 18 can be attached to the carrier 14. The fork 18 can be either horizontally fixed or vertically pivotable about the pin received in aperture 110, and, if pivotable, can be retained in a vertical position behind retainers 78 of upper pockets 64 and 66.

The carrier 14 is specifically designed to cooperatively engage blade or flat scoop load support 20 which generally comprises a base 112, a tongue 114 projecting forwardly from the base, and a standard 116 extending vertically from the base. A pair of lower brackets 118 and 120 are fixed to a rearward surface of base 112 and are intended to be received in pocket 80 and retained in the pocket by gates 90 and 92 as shown in FIG. 4. A pair of upper brackets 122 and 124 are fixed to the top of standard 116 and are intended to be received in pockets 64 and 66, respectively, as shown in detail in FIG. 3. The vertical standard 116 further includes a support 126 pivotally connected to the standard 116 by means of pivot rod 128.

The tongue 114 includes a pair of forwardly projecting legs 130 and 132 joined to base 112 at the proximal end and joined to each other by a flat blade-like projection 134 at their distal end. Adjacent the blade portion 134 and between legs 130 and 132 is a pivot plate 136 supported on pivot pins 138 and 140 extending into legs 130 and 132, respectively. The pivot plate 136 lies generally in the plane of blade portion 134, but can pivot so that the forward edge 142 lies below the plane of the blade portion 134 and the rearward edge 144 lies above the plane defined by the top surface of legs 130 and 132. In this position, the pivot plate 136 can act to pull rearwardly on a container to retrieve the same from a tier of stored goods.

A pusher plate 146 is pivotally connected at its forward edge 148 to a cross support 150 extending between legs 130 and 132. The pusher plate generally lies in the plane of tongue 114 with its rearward edge 152 supported on support bar 154 adjacent base 112. When pivoted to the vertical position shown in FIG. 1, the pusher plate 146 is retained in that position by connection with support 126. In this configuration, an article or container can be placed on a tier of containers at a position signficantly behind the working face of the tier of goods or containers. Thus, the operator of the fork lift is able to place or retrieve goods or containers which would otherwise not be placeable or retrievable in the absence of either moving the facing tier of goods or containers or having a person actually ride the load support and manually place the goods or containers on the load support.

A particularly advantageous fork 18 shown in FIG. 5 can be attached to carrier 14 by pins inserted into aperture 110 of vertical support blocks 82 and 84 through opening 160. The fork 18 includes tangs 162 pivotally engaged in slots 164 which extend longitudinally along and through the fork. The axis X—X defined by pivot pin 166 is situated such that the tangs 162 by their own mass pivot to a point where the rear surface 168 of the tang is above the upper surface 170 of the fork 18. The rear surface 168 is engageable with a container to pull it toward the attachment 10. While FIG. 5 shows only two such tangs 162, it will be appreciated that additional similar tangs could be added if deemed desirable.

Although the invention has been described in detail with reference to a preferred embodiment thereof, variations and modifications can exist within the scope and spirit of the invention as described and as defined in the following claims.

What is claimed is:

1. An attachment for a lift truck having a vertically movable carriage, the attachment comprising:

a frame, a carrier slidably engaged within the frame and attachable to the carriage of a lift truck, the carrier having at least one receiving pocket and gate means for substantially closing the receiving pocket, and a load-supporting element removably supported on the carrier, the load-supporting element including bracket means received in the receiving pocket of the carrier and retained therein by the gate means for maintaining the load-supporting element in operable position on the carrier, the gate means on the carrier comprising a pivot rod, an inverted L-shaped locking element supported on the pivot rod, biasing means for biasing the locking element toward a receiving pocket-closing position, and an actuator for moving the locking element against the biasing means toward a receiving pocket opening position.

2. The attachment of claim 1 wherein the frame comprises:

at least one guide channel, including at least one stop within the guide channel, and wherein the carrier includes a dog slidably situated in the guide channel and engageable with the at least one stop to fix the vertical relationship between the frame and carrier.

3. The attachment of claim 2 wherein the frame comprises:

a pair of guide channels, each guide channel including a plurality of apertures, and a plurality of stops adjustably positioned in the guide channel by selective engagement with at least one of the apertures.

4. The attachment of claim 2 wherein the carrier further comprises:

a bracket, said dog being movably supported on the bracket, and an actuator for moving the dog out of possible engagement with the at least one stop to selectively allow a change of the vertical relationship between the carrier and frame.

5. The attachment of claim 1 wherein the carrier further comprises:

an upper and a lower pair of pockets, and wherein the load-supporting element further comprises:

brackets received in the upper and lower pair of pockets, the gate means being situated to close only the lower pocket and thereby lock the load-supporting element to the carrier.

6. The attachment of claim 1 wherein the load-supporting element comprises:

a horizontally disposed tongue, a plate pivotally supported in the tongue between a first position substantially coplanar with the tongue and a second position substantially normal to the first position, and a support means for supporting the plate in the second position.

7. An attachment for a lift truck having a vertically movable carriage, the attachment comprising:

a frame, a carrier slidably engaged within the frame and attachable to the carriage of a lift truck, the carrier having means for removably receiving a load supporting element, a load supporting element removably supported on the carrier, the load supporting element including a base, a standard extending vertically from the base, and a tongue projecting horizontally from the base, the tongue comprising a pair of legs joined to the base and extending forwardly therefrom, a horizontal blade having a rounded forward edge fixed to the forward ends of the pair of legs, a plate pivotally supported at its forward edge between the base and the horizontal blade, the plate being movable between a first position substantially coplanar with the horizontal blade and a second position substantially normal to the first position, and a plate support means connected to the standard for supporting the plate in the second position, wherein the plate support means includes a pivot for pivotally connecting the plate support means to the standard to permit the plate support means to move from a position substantially coplanar with the standard to a plate engaging position retaining said plate in said second position.

8. The attachment of claim 7 wherein the frame comprises:

a pair of vertically oriented side channels, and wherein the carrier includes bearings received within the side channels of the frame to define a vertical path for travel of the carrier with respect to the frame.

9. The attachment of claim 7 wherein the frame comprises:

a plurality of guide channels, each guide channel including a plurality of apertures, and a plurality of stops adjustably positioned in each guide channel by selective engagement in at least one of the apertures, and wherein the carrier further comprises a bracket, said dog being pivotally supported on the bracket, an actuator for pivotally moving the dog out of possible engagement with a selected one of the stops, and a control line connected to the actuator to selectively permit a change of the vertical relationship between the carrier and frame by an occupant of a lift truck to which the attachment is attached.

10. The attachment of claim 7 wherein the carrier further comprises:

a pair of forks pivotally connected to the carrier, and retainer means for retaining the forks in a substantially vertical relationship when not in use.

11. The attachment of claim 10 wherein the pair of forks each further comprise at least one longitudinal slot passing through the fork, and a tang pivotally mounted within the slot so as to be movable from a position wholly within the outer dimensions of the fork to a position wherein a rearward surface of the tang is elevated above the upper surface of the fork.

12. The attachment of claim 7 wherein the tongue includes a plate support bar adjacent the base, the rearward edge of the plate being supported by the support bar when the plate is in said first position.

* * * * *